United States Patent [19]

Jewell

[11] Patent Number: 4,582,070

[45] Date of Patent: Apr. 15, 1986

[54] TOBACCO TREATING PROCESS

[75] Inventor: John N. Jewell, Louisville, Ky.

[73] Assignee: Brown & Williamson Tobacco Corporation, Louisville, Ky.

[21] Appl. No.: 482,756

[22] Filed: Apr. 7, 1983

[51] Int. Cl.[4] ..... A24B 3/18; A24B 1/02; A24B 3/02

[52] U.S. Cl. ..... 131/303; 131/296

[58] Field of Search ..... 131/290, 291, 300, 301, 131/302, 303, 315, 314, 352, 296, 312, 360, 903

[56] References Cited

U.S. PATENT DOCUMENTS

| | | | |
|---|---|---|---|
| 1,968,403 | 7/1934 | Kinker | 131/290 |
| 3,204,641 | 9/1965 | Jones | 131/291 |
| 3,690,328 | 9/1972 | Quarenghi | 131/291 |
| 3,734,104 | 5/1973 | Buchanan et al. | 131/296 |
| 4,094,323 | 6/1978 | Frazier et al. | 131/360 |
| 4,167,191 | 9/1979 | Jewell | 131/303 |
| 4,298,012 | 11/1981 | Wochrowski | 131/302 |
| 4,386,617 | 6/1983 | Brackmann et al. | 131/290 |

FOREIGN PATENT DOCUMENTS

| | | | |
|---|---|---|---|
| 1921072 | 5/1979 | Fed. Rep. of Germany | 131/300 |

*Primary Examiner*—Vincent Millin
*Assistant Examiner*—Gregory Beaucage
*Attorney, Agent, or Firm*—Charles G. Lamb

[57] ABSTRACT

An improved tobacco treating process for smoking articles including the steps of moistening and shredding tobacco stems at a preselected temperature range and drying such shredded stems under high humidity conditions controlled to obtain unexpectedly high fill values.

13 Claims, 1 Drawing Figure

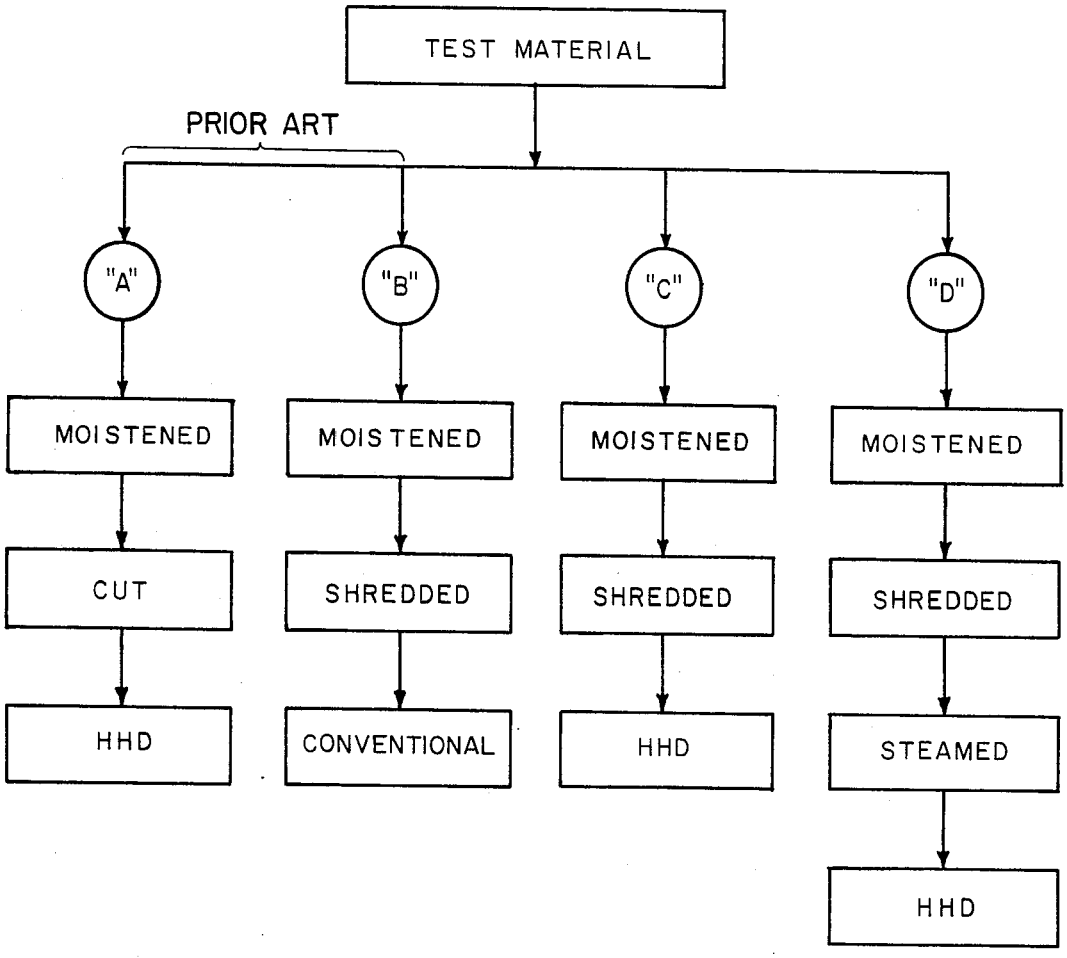
TEST MATERIAL
PRIOR ART
"A"
"B"
"C"
"D"
MOISTENED
MOISTENED
MOISTENED
MOISTENED
CUT
SHREDDED
SHREDDED
SHREDDED
HHD
CONVENTIONAL
HHD
STEAMED
HHD

TOBACCO TREATING PROCESS

BACKGROUND OF THE INVENTION (1) Field of the Invention

The invention relates to a process for treating tobacco stems and more particularly relates to a process which involves the steps of moistening tobacco stems under preselected conditions, shredding the stems, and drying the stems under high humidity conditions.

(2) Brief Description of the Prior Art

In the manufacture of smoking articles which include some preselected percentage of tobacco stems, it is the usual practice to moisten such stems to minimize shattering and provide a material of more uniform particle size prior to reducing the stems to a particle size of a preselected dimension appropriate for preparing the smoking articles in which the stems are to be included. After the stems have been moistened and reduced to the preselected particle size, it also is necessary to reduce the moisture content of the tobacco stems to a level below that in which the size reduction is conducted.

One of the manners of reducing stems to a preselected particle size is by shredding the stems prior to further treatment in order to fiberize the stem and provide increased filling capacity. Various methods are known in the art to accomplish this shredding reduction. For example, the now expired U.S. Pat. No. 3,204,641 issued to S. O'Brien Jones on Sept. 7, 1965, teaches a method of producing tobacco leaf stems by adjusting the moisture content of the stems in the percentage range of about 40% to about 65% by weight and then shredding the moistened stems to a preselected size suitable for cigarettes before drying the material to a moisture content suitable for use in cigarettes. U.S. Pat. No. 4,094,323 issued to Frazier et al, on June 13, 1978, teaches a method of moistening tobacco stems in a percentage range from about 10% to about 50% by weight while maintaining the temperatures of the stems in a range of from about 115° to about 170° C. at a preselected pressure of 10 to 100 psig and then mechanically fiberizing the treated stems under such pressure by shredding. U.S. Pat. No. 4,195,646, issued to G. F. Kite on Apr. 1, 1980, teaches a method of shredding tobacco stems by splitting the stems lengthwise along the grain by supporting the stem shards in a fluid medium and striking the shards with a blunt instrument to separate such shards into fibrilliform shred fragments. In addition, UK Patent Application No. 2,078,085, by Warren Arthur Brackman, et al, published for inspection on Jan. 6, 1982, teaches a method of soaking tobacco stems to provide a moisture content by weight of 30% to 60%, shredding the soaked stems and then drying the stems to a moisture content desired, the stems having been brought to a temperature up to the boiling point of water prior to such shredding step.

As can be seen from this aforediscussed prior art, it has long been known in the tobacco processing art, to shred tobacco stems which have been moistened to a preselected range and then to reduce the moisture content of the shreds, to a desired level for the smoking article in which the shredded stems are to be included. The reduction of the stems to the desired moisture content has been accomplished by conventional dryer means in the conventional manner to obtain the desired result.

A number of processes also are known in the art for heating and drying moistened tobacco particulates arrived at by cutting and rolling by subjecting the particulates to heated gas streams held at preselected temperatures. For example, U.S. Pat. No. 3,357,436, issued on Dec. 12, 1967, to A. H. Wright and German-Auslegeschrift No. 2,253,882, teach processes wherein moistened, cut tobacco ribs have been moistened in the range of from about 24% to 40% by weight and then dried by gases at a temperature of from 121° C. to 370° C. for brief periods of time ranging from 0.3 to 3 seconds to reach moisture contents by weight as low as 6% within a short period of time. U.S. Pat. No. 3,734,104, issued to Buchanan et al, on May 22, 1973, teaches the treating of rolled, crushed tobacco stems, which have been moistened to a content of about 24% to 60% by weight, with a hot gas stream containing at least 30% steam to heat the stems to about 205° F. to 750° F. for a brief period of time of about 0.5 to less than 3 seconds. Further, more recent U.S. Pat. No. 4,167,191, issued to John Jewell, et al, on Sept. 11, 1979, teaches a process of drying expanded cut tobacco at a temperature within the range of from about 250° F. to about 650° F. in the presence of an absolute humidity at a level above that which will provide a wet-bulb temperature of at least about 150° F.

As can be seen from the aforediscussed, these varying drying processes of the more recent past have been utilized in conjunction with cut tobacco leaf lamina and stems, all of which have been cut to a preselected size.

The present invention recognizes that it has been a desideratum of past tobacco stem shredding processes to optimize the economic use of the stems in smoking articles by converting the stems into a product suitable for inclusion as a smoking article filler with as high a fill value (FV) as possible. In addition, the present invention recognizes that it has been a desideratum of past high humidity drying as aforedescribed to reduce the moisture content of expanded tobacco generally to a desired level, while minimizing possible loss in filling power. By recognizing the aims of these two separate processing systems the present invention uniquely combines the several steps of each into a novel combination of steps to obtain fill values hereto-fore unknown in the art.

The present invention further provides a novel, economic and straightforward series of steps for treating tobacco stems to reduce their particulate size and yet at the same time to optimize their fill value for smoking article purposes.

Various other features of the present invention will become obvious to one skilled in the art upon reading the disclosure set forth hereinafter.

SUMMARY OF THE INVENTION

More particularly, the present invention provides a method for treating tobacco leaf stems to produce a product for use in smoking articles comprising the steps of: adjusting the moisture content of the tobacco leaf stems to a preselected percentage by weight; shredding the stems to a preselected particle size suitable for use in the smoking article to be produced; and reducing the moisture content of the shredded stems by heating the stems in a gas having an initial temperature within the range of from about 250° F. to about 650° F. in the presence of an absolute humidity at a level above that which will provide a wet-bulb temperature reading of at least 150° F.

BRIEF DESCRIPTION OF THE DRAWING

Referring to the drawing, the FIGURE sets forth a schematic flow sheet, illustrating broadly the steps involved in treating like test materials by four different processes, two of which are known and the third and fourth of which are in accordance with the present invention.

DETAILED DESCRIPTION OF THE INVENTION

Referring to the schematic flow sheet of the FIGURE, it can be seen that suitable tobacco test material is processed in four different manners, processes "A" and "B" being known processes in the tobacco treating art and processes "C" and "D" being in accordance with the present invention.

The first step of each process involves moistening the tobacco to a desired level by weight. In process "A", which is a known process for producing water treated stem (WTS), a preselected amount of test material is first moistened with water until the test material is about 42% water by weight. It then is cut into strips at about 160 cuts per inch and then dried under a high humidity drying process similar to that described in the Jewell, et al, U.S. Pat. No. 4,167,191 at a temperature within the range of from about 250° F. to about 650° F. in the presence of an absolute humidity at a level above that which produces a wet-bulb temperature of at least about 150° F.

In process "B", which also is a known process for treating tobacco, a like preselected amount of test material is first moistened with water until the test material is about 55% water by weight. Then instead of cutting, it is shredded on a Bauer type refiner of the double revolving disc type, such a refiner being known in the tobacco shredding art and available from Bauer Bros. Co., Springfield, Ohio. The shredding step can be satisfactorily accomplished with the powered discs spaced as much as about 0.30 inches apart and advantageously at about 0.180 inches. It is to be understood that other types of shredders can also be utilized in the shredding step. For example, a Sprout, Waldron & Co. double revolving disc shredder with the discs spaced at about 0.040 inches can be utilized. The shredded tobacco is then subject to conventional low humidity drying step on a rotary dryer at temperatures in the range of about 250° F. to 400° F.

In inventive process "C", a like preselected amount of test material is first moistened with water until the material is in the range of about 20% to about 80% water by weight (wet basis) and advantageously about 55% water by weight (as in process "B") and shredded on either a Bauer or Sprout, Waldron shredder in a manner also similar to process "B". However, the similarity of the steps ends at this point with the shredded test material being subjected to a high humidity drying process at ranges similar to that set forth in Jewell U.S. Pat. No. 4,167,191 for cut tobacco. Advantageously, in accordance with the present invention, the shredded tobacco is adjusted to a preselected inlet temperature in the range of about 60° F. to about 212° F. and the moisture content of the shredded tobacco in the present invention is reduced by heating the treated material in a mixture of air and water vapor of initially from about 250° F. to about 650° F.—advantageously at about 500° F.—in the presence of an absolute humidity at a level above that which will provide a wet-bulb temperature reading of at least 150° F.—advantageously at a wet-bulb reading of 210° F. It also has been found to be advantageous to dry the shredded stems in the aforedescribed process until the moisture content is about 5% to 25% by weight and advantageously about 14% by weight.

In inventive process "D", a like preselected amount of test material is first moistened with water until the material is in the range of about 20% to about 80% water by weight (wet basis) and advantageously about 55% water by weight (as in processes "B" and "C"). The moistened tobacco is then steamed with the moisture content of the tobacco being raised at least 2%. One advantageous means for steaming includes feeding the moistened tobacco to a stationarily mounted enclosed barrel having an advancing screw therein. Steam is introduced through openings in the bottom of the barrel in contacting relation with the tobacco advancing with the screw. The steamed tobacco is then fed to high humidity drying equipment the same as in process "C".

In carrying out the testing of materials subjected to the aforedescribed processes "A", "B", "C" and "D", two types of tobacco materials were utilized. In the first set of test results reported in Table I described hereinafter, tobacco test materials comprised entirely of tobacco stems, subjected to the four processes above described, were utilized to produce smoking articles in the form of cigarettes. In the second set of test results reported in Table II also described hereinafter, tobacco test materials comprised of a mixture of 83% by weight leaf lamina (cut at 30 cuts per inch) and 17% by weight shredded stem were utilized to produce smoking articles in the form of cigarettes. Processes "A", "B", "C", and "D", aforedescribed were utilized on the stems to arrive at the final test materials in Table II by the mixing of the lamina prepared in a known matter such as described in Jewell U.S. Pat. No. 4,167,191 and the stem tobacco in the 83% to 17% by weight, respectively, after the drying step of the stems in each of the aforedescribed processes, "A", "B", "C" and "D".

Tables I and II which are set forth hereinafter disclose the results of ten types of tests performed on the test materials produced by the abovedescribed processes "A", "B", "C" and "D". Six of the ten tests, including the "Dry Density" test, the "Tobacco Section Pressure Drop" test (TSPD), both "Carbon Monoxide" tests (cigarette and puff), the Puff Number test, and the Burn Rate test are standard tests used in the tobacco processing arts and therefore are not described in detail herein.

The Firmness test which is to determine the firmness of a population of cigarettes is run on a group of 25 cigarettes made from test tobacco which are measured for firmness by a series of 12 arm weights, each with an effective load of about 60 grams. Each 0.15 mm (approximately) of cigarette deformation is recorded as one count, each arm. Firmness counts are reported as the average of the counter totals for 25 cigarettes. These actual counts are adjusted to a standard moisture content of 13.5% by weight after determining the actual tobacco moisture content of the samples.

The Borgwaldt Fill Value (BWFV) test which is utilized to determine the fill value (FV) of the test tobacco material is run on a defined weight of test material tobacco compressed in a cylinder under a 3 Kg (free-fall) load for a duration of 30 seconds. The sample weight and the height of the compressed tobacco column are used to calculate the filling power of the sample expressed as cc/g. Results are reported at testing moisture (uncorrected) and at a calculated moisture content of 14% by weight (corrected).

The Ends Stability (ES) test which is to determine the amount of tobacco ends loss after tumbling is run on a group of 50 cigarettes made from test tobacco, weighed, placed in an oval chamber and tumbled. The oval chamber is made from 3 mm rods extending parallel the cigarettes to be tested, to provide a chamber or cage with solid end pieces. The oval chamber or cage is rotated 90 turns/minute for a 3 minute period. The difference in weight before and after testing is divided by the number of exposed tobacco ends (50 or 100, depending on the presence of filters), and the result expressed as mg. tobacco loss per end.

The Coal Retention (CR) test which is used to determine the tendency for burning coal to separate from cigarettes is run on a group of 30 cigarettes in two similar batches, each involving 15 cigarettes made from tobacco test materials. The 15 cigarettes in each batch are inserted snuggly in appropriately sized and aligned holes of a thumping bar with 55 mm. of each cigarette extending from the mouth side of the bar and the remainder from the lighting side. A lighting bar is repeatedly touched in an "on-off" manner to the ends of the cigarettes for about 10 to 15 seconds in such a manner that smoke leisurely rises from the cigarette ends. The cigarettes are allowed to burn freely almost to the thumping bar±5 mm. and when about 5 to 7 cigarettes have so burned the thumping bar is tapped for 30 seconds. The number of coals retained on cigarettes included in the tests of the two batches (fast and slow burning cigarettes not burned to within a certain mark are excluded) is divided by the number of cigarettes counted in the test and multiplied by 100 to determine the percentage of "coals" retained.

The results of these ten tests as reported in Table I and Table II are as follows:

TABLE I

| Process | (All stem cigarettes at equal density) "A" | "B" | "C" | "D" |
|---|---|---|---|---|
| 1. Firmness Test (County/25 cig.) Equal Moisture Content/Density (1) | 167 | 177 | 80 | 122 |
| 2. Dry Density Test (mg/cc) | 160 | 160 | 160 | 160 |
| 3. Tobbaco Section Press. Drp. Test (in.$H_2O$) (2) | 3.7 | 0.9 | 2.6 | 1.7 |
| 4. CO Test (mg/cig.) (2) | 10.6 | 9.6 | 9.6 | 10.0 |
| 5. CO Test (mg/puff) (2) | 2.8 | 2.2 | 2.0 | 2.2 |
| 6. Puff No. Test (2) | 3.8 | 4.3 | 4.8 | 4.6 |
| 7. Burn Rate Test (2) | 9.9 | 8.3 | 8.0 | 8.6 |
| 8. Borgwaldt Fill Value Test (cc/g) (3) | 5.5 | 5.7 | 8.0 | 7.2 |
| 9. Ends Stability Test (mg/cig) | 1.0 (4) | 57.0 (4) | 7.0 (5) | 18.0 (6) |
| 10. Coals Retention Test (%) | 94 (4) | 96 (4) | 100 (5) | 100 (6) |

(1) 13.5% moisture content/160 mg/cc.
(2) At 160 mg/cc
(3) 14% moisture content
(4) At approx. 166 mg/cc
(5) At approx. 130 mg/cc
(6) At appr. 136 mg/cc

TABLE II

| Process | (83% cut leaf lamina and 17% stem) "A" | "B" | "C" | "D" |
|---|---|---|---|---|
| 1. Firmness Test (County/25 cig.) Equal Moisture Content/Density (1) | 172 | 172 | 149 | 158 |
| 2. Dry Density Test (mg/cc) | 198 | 198 | 198 | 198 |
| 3. Tobbaco Section Press. Drp. Test (in.$H_2O$) (2) | 2.9 | 2.2 | 2.8 | 2.7 |
| 4. CO Test (mg/cig.) (2) | 15.7 | 15.0 | 15.3 | 14.6 |
| 5. CO Test (mg/puff) (2) | 2.3 | 2.1 | 2.2 | 2.0 |
| 6. Puff No. Test (2) | 6.7 | 7.2 | 7.1 | 7.2 |
| 7. Burn Rate Test (2) | 5.1 | 5.1 | 5.1 | 5.1 |
| 8. Borgwaldt Fill Value Test (cc/g) (3) | 4.7 | 4.7 | 5.0 | 4.8 |
| 9. Ends Stability Test (mg/cig) | 3.0 (4) | 8.0 (4) | 3.0 (4) | 6.0 (5) |
| 10. Coals Retention Test (%) | 100 (4) | 99 (4) | 100 (4) | 100 (5) |

(1) 13.5% moisture content/198 mg/cc.
(2) At 198 mg/cc
(3) 14% moisture content
(4) At approx. 187 mg/cc
(5) At approx. 190 mg/cc By way of explanation of the Tables, in all of the tests except three, a comparatively lower or equal figure across under the process columns "A", "B", "C", and "D" indicates a more favorable conditions. This would apply for 1. Firmness Test; 2. Dry Density Test; 3. Tobacco Section Pressure Drop Test; 4. and 5. CO Tests; 7. Burn Rate Tests; and 9. Ends Stability Test. A comparatively higher figure under the process columns "A", "B", "C", and "D", indicates a more favorable condition. This would apply for 6. Puff No. Test; 8. Borgwaldt Fill Value Test; and 10. Coals Retention Test. Thus, by reviewing the numbers under inventive processes "C" and "D" in light of the above, it can be seen that generally a more favorable or at least a substantially equal resulting test number is indicated when compared with the test numbers of known processes "A" and "B". The increases in the fill value number and the puff number when comparing these numbers under processes "A" and "C", and "A" and "D" should be particularly noted since this unexpected result is of significance. It also should be noted in Table I that although the Ends Stability Tests for process "C" and "D" were higher than for process "A" when desirably they should be lower, due to the fact that the testing material in Table I was all stem it was only possible to obtain 130 mg/cc per cigarette in process "C" and 136 mg/cc per cigarette in process "D" as distinguished from the 166 mg/cc per cigarette for the cigarettes produced by processes "A" and "B".

From the aforegoing, it can be seen that the present invention provides a new combination of steps in treating tobacco stems to optimize their fill value for smoking purposes.

The invention claimed is:

1. A method of treating tobacco leaf stems to produce a product for use in smoking articles comprising the steps of: adjusting the moisture content of said tobacco leaf stems to a preselected percentage by weight; shredding said stems between spaced-apart disc-like fiberizing surfaces producing a particle size suitable for use in the smoking articles to be produced; and reducing the moisture content of said shredded stems by heating said stems in a gas having an initial temperature within the range of from about 250° F. to about 650° F. in the presence of an absolute humidity at a level above that which will provide a wet-bulb temperature reading of at least 150° F.

2. The method of claim 1 wherein said reading is about 180° F.

3. The method of claim 1 wherein the moisture content of said stems is adjusted to a preselected percentage by weight in the range of about 20% to about 80% (wet basis).

4. The method of claim 1 wherein said initial temperature is about 500° F. and said reading is at least about 180° F.

5. The method of claim 1 wherein said gas is a mixture of air and water vapor.

6. The method of claim 1 wherein said gas is superheated steam.

7. The method of claim 1 wherein said shredding is effected between disc-like fiberizing surfaces spaced apart at about 0.040 inches to about 0.30 inches.

8. The method of claim 1 wherein said shredding is effected between disc-like fiberizing surfaces spaced apart at about 0.180 inches.

9. The method of claim 1 wherein said tobacco leaf stems are adjusted to a preselected inlet temperature in the range of about 60° F. to about 212° F.

10. The method of claim 1 wherein said tobacco stems are dried to a moisture content of 5 to 25% by weight.

11. The method of claim 10 wherein said moisture content is about 14%.

12. The method of claim 1 including the step of steaming the shredded stem prior to reducing the moisture.

13. The method of claim 12 wherein said steaming increases the moisture content of the shredded stem by at least 2% moisture.

* * * * *